United States Patent [19]

Heidan

[11] 4,372,135

[45] Feb. 8, 1983

[54] HORIZONTAL WASHER APPARATUS

[75] Inventor: Klaus Heidan, Krefeld, Fed. Rep. of Germany

[73] Assignee: Greenville Steel Textile Machinery Corporation, Greenville, S.C.

[21] Appl. No.: 38,411

[22] Filed: May 11, 1979

[51] Int. Cl.[3] ..... D06B 3/12

[52] U.S. Cl. ..... 68/22 R; 68/62; 68/184; 68/207; 68/208; 68/27

[58] Field of Search ..... 68/5 E, 22 R, 27, 62, 68/181 R, 184, 205 R, 207, 208

[56] References Cited

U.S. PATENT DOCUMENTS

| | | | |
|---|---|---|---|
| 3,145,554 | 8/1964 | Grimes | 68/27 X |
| 3,950,802 | 4/1976 | Schiffer et al. | 68/181 R X |
| 4,004,879 | 1/1977 | Meier-Windhorst et al. | 68/181 R X |
| 4,092,839 | 6/1978 | Bahre et al. | 68/19 |
| 4,095,442 | 6/1978 | Brugman | 68/18 C |
| 4,150,449 | 4/1979 | Talbert | 68/181 R X |

FOREIGN PATENT DOCUMENTS

| | | | |
|---|---|---|---|
| 2518770 | 11/1976 | Fed. Rep. of Germany | 68/181 R |
| 2521600 | 11/1976 | Fed. Rep. of Germany . | |
| 2736604 | 2/1979 | Fed. Rep. of Germany | 68/5 E |

*Primary Examiner*—Philip R. Coe

*Attorney, Agent, or Firm*—Cushman, Darby & Cushman

[57] ABSTRACT

Apparatus for the continuous wet treatment of moving textile webs, commonly called a horizontal washer. Two vertical columns of horizontal rollers are provided horizontally spaced from each other with a textile web entry at a lower portion of one side of a chamber containing the rollers, and an exit of the web at the opposite side of the chamber. A treatment liquid introducing structure is provided at the top of the chamber, and in order to provide additional treatment capacity (especially for heavy, tight fabrics) a treating liquid introducing structure is provided at an intermediate portion of the chamber vertically between the web entry and the top liquid introducing struture. The intermediate liquid introducing structure comprises a liquid seal which provides the web exit, troughs extending from either side of the liquid seal to provide drain off into the seal and overflow from the seal onto a portion of the moving web. A drain tank is disposed on the bottom of the chamber, taking up only about one-half of the area of the chamber bottom, on the exit side of the chamber. The web entrance is provided by a shallow liquid seal adjacent the drain tank. A series of chambers preferably is provided utilizing either a recirculation system or a counterflow system, and a heat exchanger can be provided to preheat fresh treating liquid with spent treating liquid.

12 Claims, 5 Drawing Figures

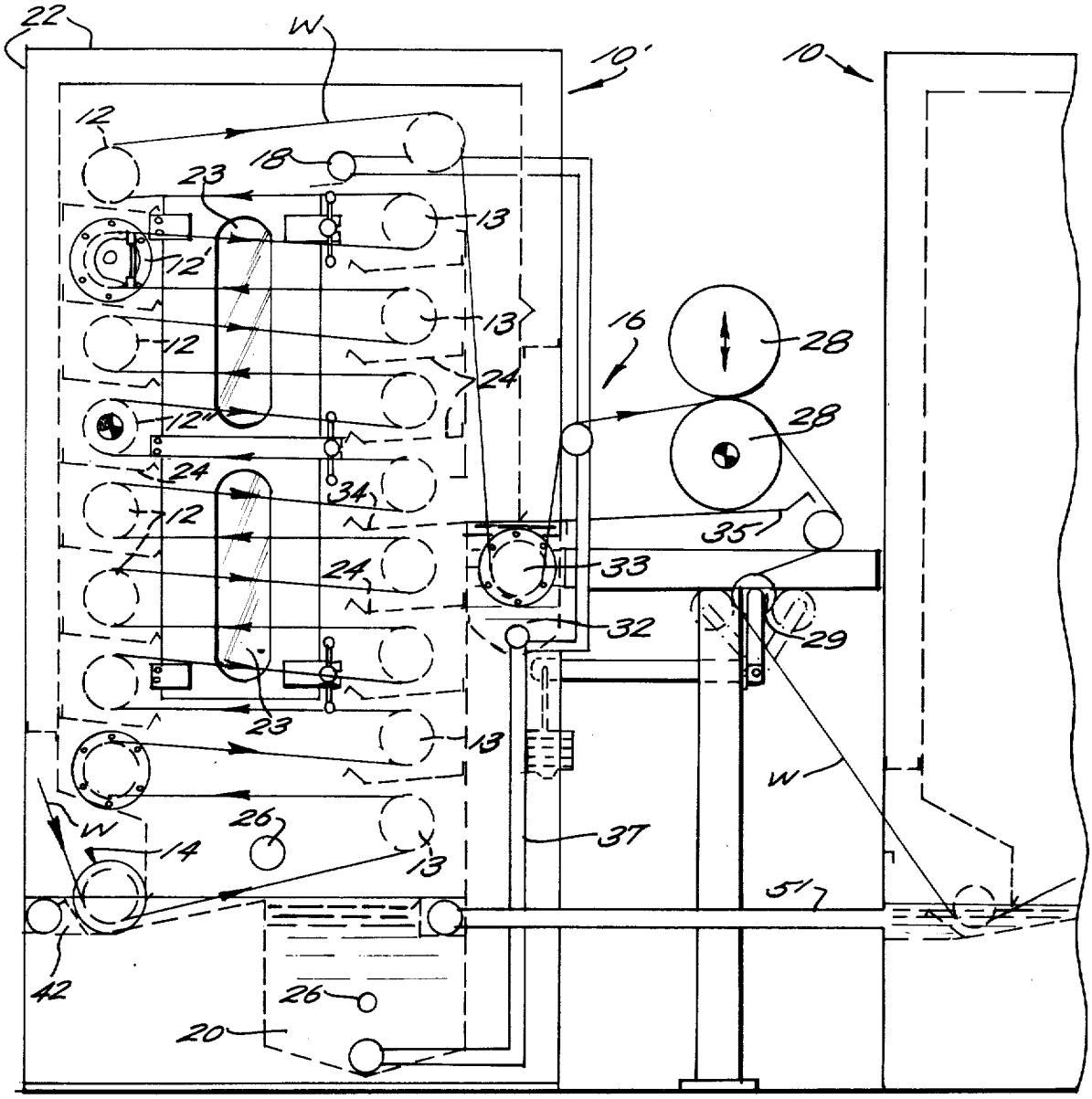
Fig. 1
Fig. 4b
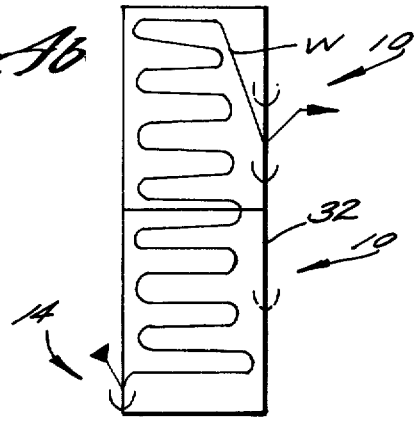
Fig. 4a
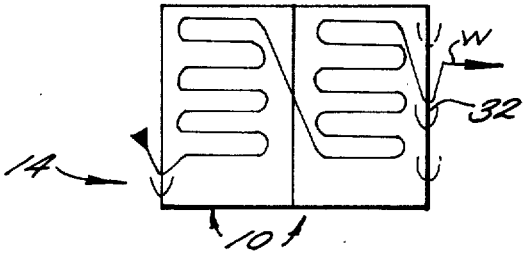

HORIZONTAL WASHER APPARATUS

BACKGROUND AND SUMMARY OF THE INVENTION

For a wide variety of industrial textile wet treatment processes—such as washing, bleaching, scouring, mercerization, dyeing, and desizing—apparatus commonly referred to as a horizontal washer has proven to be very practical and effective. Such apparatus, which is generally described in U.S. Pat. No. 4,095,442 and German Off. 2,521,600, includes a chamber through which the web passes in serpentine fashion along substantially horizontal, vertically spaced, travel paths. The web is supported by a plurality of rollers rotatable about horizontal axes and disposed in two vertical columns, the rollers in each column being horizontally spaced from the rollers in the other column and vertically offset with respect thereto. An entry for the web is provided at the lower portion on one side of the chamber, and an exit for the web is provided on the opposite side of the chamber, usually at the bottom or top. Means are provided for introducing treating liquid (e.g., wash or rinse water) at the top of the chamber to pass downwardly in the chamber to treat the web at various horizontal travel paths. A drain tank is also provided at the bottom of the chamber, occupying substantially the entire bottom thereof.

While such apparatus is eminently suited for the continuous wet treatment of moving webs, oftentimes the effective treatment capacity of a chamber is reduced as a result of the inability of the treatment liquid to pass properly from one web level to the next, the lower web travel paths sometimes remaining untreated, the web receiving treatment until it passes to the upper travel path closer to the treatment liquid introducing structure. Such reduction in treatment capacity is especially characteristic of heavy, tight fabric constructions (densely beaten woven fabrics). One suggested approach for minimizing this problem is provided in U.S. Pat. No. 4,092,839 wherein a plurality of accessory roller systems are provided mounted at one side of the chamber, with immersion pans associated with such roller systems, and with the treatment liquid introducing structure oriented to spill onto that side of the chamber. In this structure, an accessory liquid seal is provided at the bottom of the chamber at the web exit.

Another problem sometimes encountered with conventional horizontal washers is a low turnover rate of treatment liquid, and greater than desired steam consumption, due in part to the large volume of the drain tank provided at the bottom of the chamber, relatively large liquid volumes in the liquid seals, and due to the sewering of the spent treatment liquid from the last of any series of treatment chambers.

According to the present invention, the above-mentioned drawbacks associated with conventional horizontal washers have been eliminated. The problem of reduced treatment capacity is overcome by providing means for introducing treating liquid into the chamber at an intermediate portion of the chamber vertically between the top liquid introducing structure and the web entry. Preferably such intermediate treatment liquid introducing structure comprises a liquid seal forming the web exit. A trough disposed adjacent the top of the liquid seal may extend into the chamber and direct overflow from the liquid seal onto the web at a horizontal travel path thereof, and another trough may extend out from the chamber to a point under a pair of squeezing rollers for directing liquid squeezed out of the web by the squeezing rollers to the liquid seal. Such an arrangement provides a minimum amount of additional structure compared to prior art arrangements, yet results in the desired flow effective treatment capacity of the washer.

The problem of low treatment liquid turnover rate and high steam consumption is solved, according to the present invention, by providing the entry and exit liquid seals of low volume, and by providing the drain tank of much less volume, the drain tank taking up only about one-half of the bottom area of the chamber, on the side thereof at which the web exit is provided. Additionally, the chambers can be provided in series, and the spent treatment liquid from the first chamber of the series can be passed through a heat exchanger with fresh treatment liquid for the last chamber of the series to thereby preheat the fresh treatment liquid, and minimize steam consumption.

Additionally, according to the present invention by the proper interconnection of treatment chambers (either in a recirculation system or a counterflow system), liquid is introduced at a point where the degree of contamination (or how spent the liquid is) matches the liquid in the counterflow, so that as the liquid moves from the last to the first treatment chamber it becomes progressively more contaminated (or expends more of its chemical treating capacity).

It is the primary object of the present invention to provide an improved horizontal washer. This and other objects of the invention will become clear from an inspection of the detailed description of the invention, and from the appended claims.

BRIEF DESCRIPTION OF THE DRAWINGS

FIG. 1 is a side schematic view illustrating an exemplary treatment chamber of apparatus according to the present invention;

FIGS. 4*a* and 4*b* are schematic illustrations of modified configurations and interconnections between treatment chambers that may be provided in practicing the present invention.

DETAILED DESCRIPTION OF THE DRAWINGS

Figure 2:
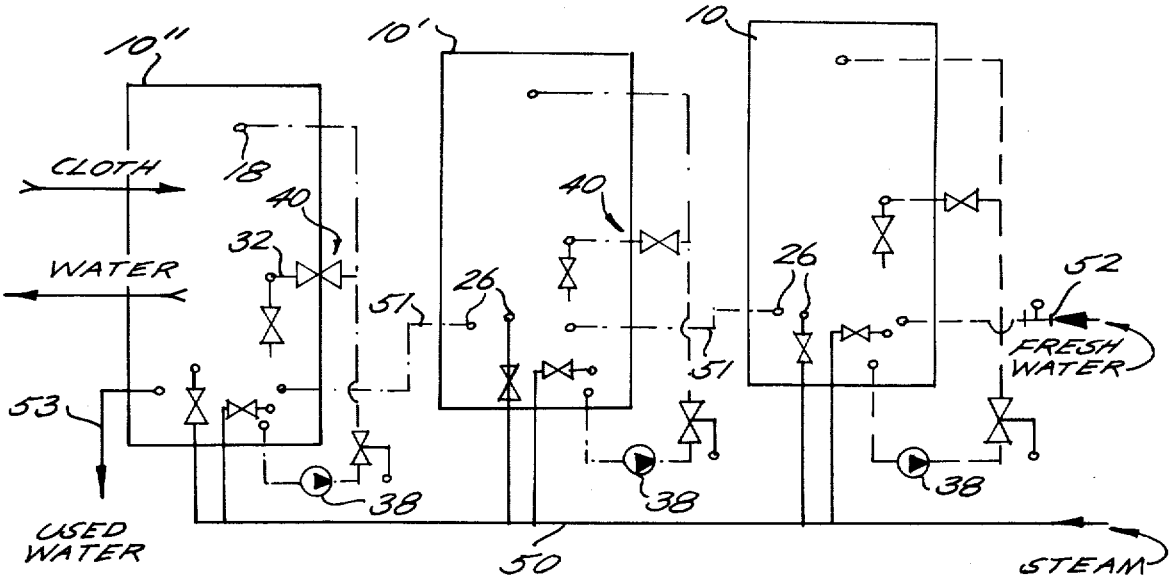
FIGS. 2 and 3 are schematic illustrations of the interconnection between various treatment chambers according to FIG. 1, in a counterflow system and in a recirculation system, respectively.

Exemplary apparatus for the continuous wet treatment of moving textile webs is shown generally at 10, 10', and 10'' in the drawings. An exemplary chamber 10' is illustrated most clearly in FIG. 1, with the chambers 10 and 10'' being substantially identical to chamber 10'. The apparatus 10' is conventionally referred to as a horizontal washer, and while it will be described in detail with particular reference to its functioning as a textile washing structure, such apparatus is equally applicable to all other types of industrial textile wet treatment processes such as rinsing, bleaching, scouring, mercerization, dyeing and desizing.

With particular reference to FIG. 1, the apparatus 10' includes a chamber through which a textile web W passes in serpentine fashion along substantially horizontal, vertically spaced, travel paths. The web is supported by a plurality or rollers rotatable about horizontal axes and disposed in two vertical columns, rollers 12 provided in one vertical column, and rollers 13 provided in the other vertical column. The rollers 12, 13 are horizontally spaced from each other and vertically offset with respect to each other. At least one of the rollers is driven, such as the roller 12'. For delicate textiles an additional drive can be provided at roller 12'' if desired.

An entry 14 is provided for the web W at a lower portion of one side of the chamber, and an exit 16 is provided for the web W at the opposite side of the chamber. Means are provided for introducing wash water at the top of the chamber to pass downwardly in the chamber to treat the web at various horizontal travel paths, such as an elongated spray pipe 18. A drain tank 20 is provided at the bottom of the chamber for collecting any liquid that drains downwardly through the web and/or for holding liquid introduced from another source. All of the structures 12, 13, 14, 16, 18 and 20 are mounted in a steam-tight housing 22, which may include viewing openings 23, as is conventional. Additionally, troughs 24 may be provided disposed below the rollers 12, 13 for collecting water that drops thereon from the roller with which it is associated, and allowing overflow of that water onto the next lowest horizontal travel path of the web W.

As is also conventional, preferably steam spargers 26 are provided for heating the liquid end tank 20, and for heating the web W. When the web W exits from the exit 16, a pair of squeeze rolls 28 preferably are provided for squeezing excess liquid out of the web, the web then passing around adjustable directing roller 29 to the web entrance of the next succeeding treatment apparatus (10 in FIG. 1).

According to the present invention, means are provided for introducing the wash water into the chamber of apparatus 10' at an intermediate portion thereof vertically between the spray pipe 18 and web entrance 14. Such means desirably takes the form of a water seal 32, which provides the web exit 16. A redirecting roll 33 is provided in the water seal 32, and a trough 34 is disposed adjacent the top of the water seal 32 to direct overflow from the liquid seal 32 onto the web W at the next lowest horizontal travel path thereof. The water seal 32 may also include a trough 35 extending outwardly from the chamber and disposed underneath the squeezing rollers 28 to collect liquid squeezed thereby and direct it back into the liquid seal 32.

Figure 3:
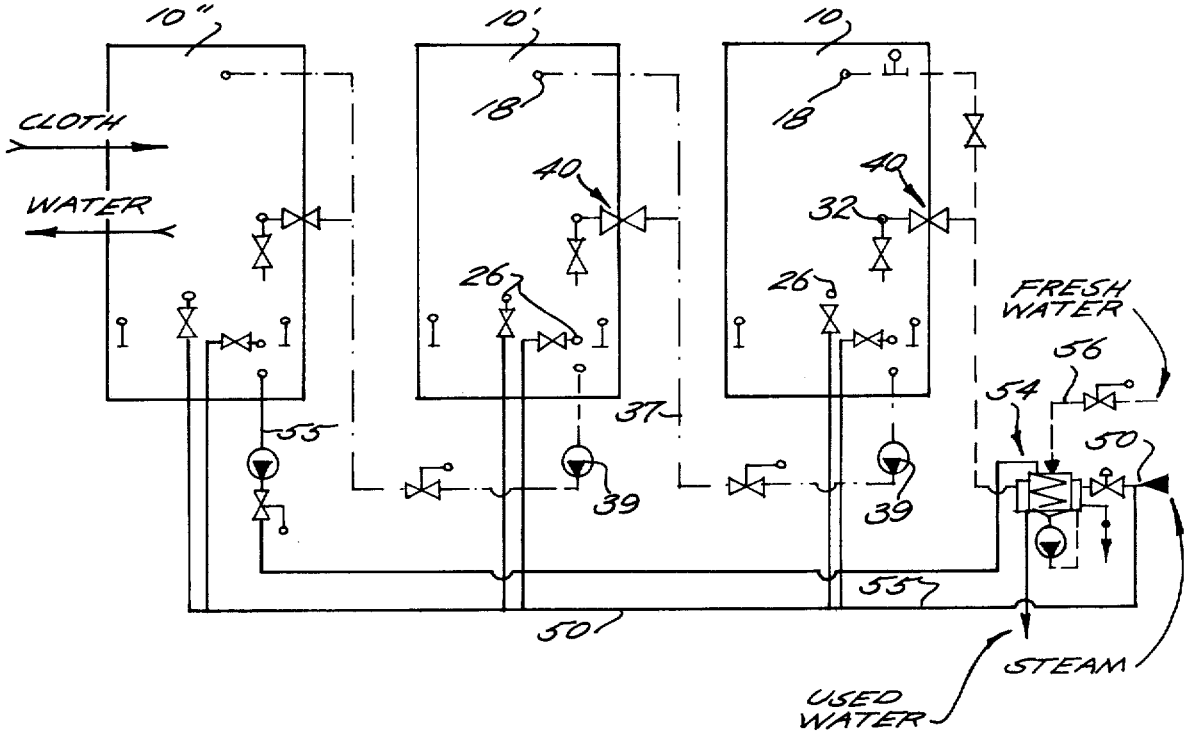

The liquid introducing means according to the invention also preferably comprises a common conduit 37 for delivering water to the water seal 32 and the spray pipe 18, as shown in FIGS. 1 through 3. The conduit 37 may—as illustrated in FIGS. 1 and 2—be connected up to the drain tank 20 of the chamber (e.g., 10') with which it is associated, a pump 38 (see FIG. 2) being provided to pump water from the tank 20 through the conduit 37. Alternatively, the conduit 37 can be connected up to the drain tank 20 associated with the next succeeding chamber in a series of such chambers, as illustrated in FIG. 3, in which case a pump 39 pumps liquid from the next succeeding drain tank into the conduit 37. A valve arrangement 40 (see FIGS. 2 and 3) may be provided for selectively cutting off the flow of liquid from the conduit 37 to the water seal 32.

The drain tank 20 is preferably constructed as illustrated in FIG. 1, taking up only about one-half the bottom of the chamber of the apparatus 10', on the side of the chamber at which the web exit 16 is disposed. A shallow liquid seal 42 is provided as the web entrance 14, the shallow liquid seal 42 being adjacent the drain tank 20, with liquid overflowing from the drain tank flowing into the liquid seal 42, as indicated in FIG. 1.

In the construction of the apparatus 10', techniques may be employed to ensure high quality and easy serviceability thereof. For instance, the counterflow troughs 24 may be welded directly to the housing 22 to eliminate vibration during operation at maximum speeds and provide high rigidity in the bearing areas. Additionally, only the rollers at the liquid seals 32, 42 need have carbon bearings, and such bearings can be made accessible from the outside of the housing 22. Preferably large diameter pipes are utilized to reduce lint problems, and the entire housing 22 can be insulated to maintain an outside temperature of the housing 22 of about 70° F. while the treatment water temperature is at about 205° F.

As previously indicated, preferably a series of chambers 10, 10', 10'', are provided with the web W extending from the exit 16 of one chamber to the entrance 14 of the succeeding chamber. A series of such chambers is illustrated connected up in a counterflow system in FIG. 2. In such a system, steam is introduced via line 50 to the steam spargers 26 located in each chamber, and a conduit 51 is provided from the liquid seal of each succeeding chamber to the drain tank 20 of the next chamber. For the last chamber (10) water is introduced into the drain tank 20 via line 52 from a fresh water source, and at the first chamber (10'') the contaminated water (spent treatment liquor) is withdrawn from the water seal 14 by the conduit 53 and sewered. Alternatively, the contaminated water in line 53 can be run through a heat exchanger with the fresh water in conduit 52 to preheat the fresh water in conduit 52. Such an exemplary heat exchanger is illustrated at 54 in FIG. 3, the heat exchanger 54 in FIG. 3 being connected up in a recirculation system as opposed to a counterflow system, however.

In the recirculation system of FIG. 3, water from the drain tank of each succeeding chamber is pumped via pumps 39 to the conduit 37 of the preceding chamber. The withdrawal conduit 55 for contaminated water (spent treatment liquor) from the first chamber (10'') passes through the heat exchanger 54 in heat exchanging relationship with fresh water in conduit 56, which supplies water to the introducing structures 18, 32 of the last chamber (10). Additionally, steam from line 50 can supplement the preheating of the fresh water in line 56. After passing through heat exchanger 54, the water from line 55 is ultimately sewered.

Alternative arrangements for treatment chambers 10 according to the present invention are illustrated in FIGS. **4*a* and 4*b*. In FIG. 4*a* two chambers 10 are disposed side-by-side with no exposure of the web between successive chambers, whereby temperature drops are reduced. In the FIG. 4*b* embodiment, a pair of chambers 10 are disposed one on top of the other, with the intermediate liquid introducing structure 32 thus located adjacent the bottom of the top chamber 10**.

Utilization

An exemplary utilization of the apparatus according to the present invention will now be described with respect to FIGS. 1 and 2. A web to be washed is introduced into the entrance liquid seal 42 of the first chamber (10'') and fresh wash water is introduced through line 52 into the last chamber (10). The web W passes upwardly in the chamber in a zigzag path around the rollers 12, 13, being driven by the roller 12'. Water is introduced through the spray pipe 18 and the exit seal 32 and trough 34 onto the moving web, the water passing downwardly to the various horizontal travel paths of the web and providing maximum washing capacity in the chamber, all horizontal levels of the web in the chamber being washed at the same time. Washing liquid is supplied to the structures 18, 32 by pump 38 pumping water from the drain tank 20 through the conduits 37.

Water that drains downwardly through the chambers, and is introduced from the succeeding chamber via conduit 51 (or from the fresh water source 52).

The consumption of steam introduced through spargers 26 (and/or for preheating water in conduit 52) is minimized by providing the tank 20 of low volume, and providing the seals 32, 42 of low volume. Insulation of the housings 22 further minimizes steam consumption, and the contaminated water from discharge conduit 53 can be passed through a heat exchanger (54) to preheat the fresh water (for conduit 42) to further minimize steam consumption. The web W as it emerges from the last treatment chamber (10) is completely washed.

It will thus be seen that according to the present invention an improved horizontal washer has been provided. While the invention has been herein shown and described in what is presently conceived to be the most practical preferred embodiment thereof, it will be apparent to those of ordinary skill in the art that many modifications may be made thereof within the scope of the invention, which scope is to be accorded the broadest interpretation of the appended claims so as to encompass all equivalent apparatus and assemblies.

What is claimed is:

1. Apparatus for the continuous wet treatment of moving textile webs, including a chamber through which the web passes in serpentine fashion along substantially horizontal, vertically spaced, travel paths supported by a plurality of rollers rotatable about horizontal axes and disposed in two vertical columns, the rollers in each column being horizontally spaced from the rollers in the other column and vertically offset with respect thereto; an entry for the web at a lower portion on one side of said chamber; an exit for the web at the opposite side of said chamber; means for introducing treating liquid at the top of said chamber to pass downwardly in said chamber to treat the web at various horizontal travel paths;

and a liquid seal at said web exit comprising means for introducing treating liquid into said chamber at an intermediate portion of said chamber, vertically between said means for introducing treating liquid at the top of said chamber, and said web entry, so that liquid overflowing from said liquid seal provides treating liquid to said chamber at and below said web exit; said liquid seal having a redirecting roller provided therein;

said means for introducing treating liquid at an intermediate portion further comprising a trough disposed adjacent the top of said liquid seal and directing overflow from said liquid seal into the web at a horizontal travel path thereof.

2. Apparatus as recited in claim 1 further comprising a pair of squeezing rollers disposed exterior of said chamber adjacent said web exit, and wherein said means for introducing treating liquid at an intermediate portion of said chamber comprises a trough extending out from said chamber to under said squeezing rollers for directing liquid squeezed out by said squeezing rollers to said liquid seal.

3. Apparatus for the continuous wet treatment of moving textile webs, including a chamber through which the web passes in serpentine fashion along substantially horizontal, vertically spaced, travel paths supported by a plurality of rollers rotatable about horizontal axes and disposed in two vertical columns, the rollers in each column being horizontally spaced from the rollers in the other column and vertically offset with respect thereto; an entry for the web at a lower portion on one side of said chamber; an exit for the web at the opposite side of said chamber; means for introducing treating liquid at the top of said chamber to pass downwardly in said chamber to treat the web at various horizontal travel paths; and a drain tank disposed at the bottom of said chamber for collecting liquid that drains downwardly through the web; wherein the improvement comprises said drain tank disposed on only the bottom of the side of the chamber on which said web exit is disposed, said drain tank occupying only about one-half of the bottom area of said chamber.

4. Apparatus as recited in claim 3 further comprising a shallow liquid seal providing said web entrance, said liquid seal being adjacent said drain tank, with liquid overflowing from said drain tank flowing into said liquid seal.

5. Apparatus for the continuous wet treatment of moving textile webs, including a chamber through which the web passes in serpentine fashion along substantially horizontal, vertically spaced, travel paths supported by a plurality of rollers rotatable about horizontal axes and disposed in two vertical columns, the rollers in each column being horizontally spaced from the rollers in the other column and vertically offset with respect thereto; an entry for the web at a lower portion on one side of said chamber; an exit for the web at the opposite side of said chamber; means for introducing treating liquid at the top of said chamber to pass downwardly in said chamber to treat the web at various horizontal travel paths; means for introducing treating liquid into said chamber at an intermediate portion of said chamber, vertically between said means for introducing treating liquid at the top of said chamber, and said web entry; a drain tank disposed at the bottom of said chamber for collecting any liquid that drains downwardly through the web and for holding liquid introduced from another source; and wherein said means for introducing treating liquid at the top of said chamber and at an intermediate portion of said chamber comprises a common liquid conduit extending from said drain tank to the intermediate portion and the top of said chamber, with a pump in operative communication with said conduit to pump liquid from said drain tank into said conduit.

6. Apparatus as recited in claim 5 further comprising a series of said chambers disposed in series so that the web moves from the exit of one chamber to the entrance of the succeeding chamber; and wherein said another source of liquid for each drain tank comprises a conduit extending from a water source in the succeeding chamber.

7. Apparatus as recited in claims 5 or 6 wherein said drain tank is disposed on only the bottom of the side of said chamber on which said web exit is disposed, and wherein a shallow liquid seal provides said web entrance, and is adjacent said drain tank.

8. Apparatus as recited in claim 6 wherein said liquid source in the succeeding chamber comprises a liquid seal at said web entrance for the succeeding chamber.

9. Apparatus for the continuous wet treatment of moving textile webs, including a chamber through which the web passes in serpentine fashion along substantially horizontal, vertically spaced, travel paths supported by a plurality of rollers rotatable about horizontal axes and disposed in two vertical columns, the rollers in each column being horizontally spaced from the rollers in the other column and vertically offset with respect thereto; an entry for the web at a lower portion on one side of said chamber; an exit for the web at the opposite side of said chamber; means for introducing treating liquid at the top of said chamber to pass downwardly in said chamber to treat the web at various horizontal travel paths; means for introducing treating liquid into said chamber at an intermediate portion of said chamber, vertically between said means for introducing treating liquid at the top of said chamber, and said web entry; a series of said chambers disposed in series so that the web moves from the exit of one chamber to the entrance of the succeeding chamber, and including first and last chambers; and wherein said means for introducing treating liquid into the last chamber at the top and intermediate portion thereof comprises a conduit extending from a fresh liquid source, and further comprising means for preheating fresh liquid in said conduit, said preheating means comprising a spent liquid discharge conduit extending from said first chamber, and a heat exchanger through which said conduits extend for transferring heat from said spent liquid to said fresh liquid.

10. Apparatus for the continuous wet treatment of moving textile webs, including a chamber through which the web passes in serpentine fashion along substantially horizontal, vertically spaced, travel paths supported by a plurality of rollers rotatable about horizontal axes and disposed in two vertical columns, the rollers in each column being horizontally spaced from the rollers in the other column and vertically offset with respect thereto; an entry for the web at a lower portion on one side of said chamber; an exit for the web at the opposite side of said chamber; means for introducing treating liquid at the top of said chamber to pass downwardly in said chamber to treat the web at various horizontal travel paths;

means for introducing treating liquid into said chamber at an intermediate portion of said chamber, vertically between said means for introducing treating liquid at the top of said chamber, and said web entry; a series of said chambers disposed in series so that the web moves from the exit of one chamber to the entrance of the succeeding chamber, and wherein each chamber further comprises a drain tank disposed at the bottom of said chamber; and wherein each said means for introducing treating liquid at the top and at an intermediate portion of said chamber comprises a common liquid conduit extending from said drain tank of the succeeding chamber, with a pump disposed in operative communication with said conduit to pump liquid from said drain tank into said conduit.

11. Apparatus as recited in claims 5, 9 or 10 wherein said means for introducing treating liquid into said chamber at an intermediate portion of said chamber comprises a liquid seal, with a redirecting roller provided therein, which provides said web exit.

12. Apparatus for the continuous wet treatment of moving textile webs, including a chamber through which the web passes in serpentine fashion along substantially horizontal, vertically spaced, travel paths supported by a plurality of rollers rotatable about horizontal axes and disposed in two vertical columns, the rollers in each column being horizontally spaced from the rollers in the other column and vertically offset with respect thereto; an entry for the web at a lower portion on one side of said chamber; an exit for the web at the opposite side of said chamber; means for introducing treating liquid at the top of said chamber to pass downwardly in said chamber to treat the web at various horizontal travel paths;

a liquid seal at said web exit comprising means for introducing treating liquid into said chamber at an intermediate portion of said chamber, vertically between said means for introducing treating liquid at the top of said chamber, and said web entry, so that liquid overflowing from said liquid seal provides treating liquid to said chamber at and below said web exit; said liquid seal having a redirecting roller provided therein;

a drain tank disposed at the bottom of said chamber for collecting any liquid that drains downwardly through the web and for holding liquid introduced from another source; and wherein said means for introducing treating liquid at the top of said chamber and at an intermediate portion of said chamber comprises a common liquid conduit extending from said drain tank to the intermediate portion and the top of said chamber, with a pump in operative communication with said conduit to pump liquid from said drain tank into said conduit.

* * * * *